United States Patent [19]

Weisheit

[11] 4,009,665

[45] Mar. 1, 1977

[54] SHELF ASSEMBLY

[76] Inventor: Andreas Weisheit, Rosenweg 4, 5974 Herscheid, Germany

[22] Filed: Aug. 21, 1975

[21] Appl. No.: 606,579

[30] Foreign Application Priority Data

Aug. 24, 1974 Germany ..... 7428708[U]

[52] U.S. Cl. ..... 108/111; 108/114; 108/153; 312/257 R; 403/219

[51] Int. Cl.[2] ..... A47B 47/04

[58] Field of Search ..... 108/114, 64, 111, 153; 211/148; 52/285; 403/219, 315, 316, 331; 312/108, 111, 257 R

[56] References Cited

UNITED STATES PATENTS

| | | | |
|---|---|---|---|
| 348,252 | 8/1886 | Walsh | 108/114 |
| 1,883,586 | 10/1932 | Corrington | 403/331 |
| 2,441,364 | 5/1948 | Maynard | 52/285 |
| 2,783,107 | 2/1957 | Gacht | 108/64 |
| 3,832,957 | 9/1974 | Mendenhall | 108/64 |
| 3,841,052 | 10/1974 | Metz | 52/285 |

FOREIGN PATENTS OR APPLICATIONS

| | | | |
|---|---|---|---|
| 17,959 | 8/1915 | United Kingdom | 312/107 |

*Primary Examiner*—James T. McCall
*Assistant Examiner*—William E. Lyddane

[57] ABSTRACT

A shelf assembly comprises flat base panels, side panels and back panels adapted to be assembled into a unitary structure. The base panel has connecting ledges extending from one edge of the base panel to the center line thereof. The front faces of adjacent connecting ledges have, respectively, complementary pegs and holes. The lateral surfaces of adjacent connecting ledges are provided with complementary pegs and oblong holes to permit sliding engagement thereof. The side faces of the connecting ledges and the back portions of the base panels are provided with holes to receive pegs extending from the back and side panels. Sliding engagement of corresponding connecting ledges cooperates with the peg and hole connections to provide a statically stable, torsion resistant assembly without the use of additional mechanical fastening devices.

10 Claims, 4 Drawing Figures

SHELF-ASSEMBLY

The present invention concerns a shelf assembly with plug-in base panels, side panels and back panels.

The invention is concerned with the problem of providing a shelf assembly which can be assembled from base panels, side panels and back panels without any additional connecting elements, and which is a statically stable assembly.

The problem is solved according to the invention, as follows: (To help distinguish various connector elements in the following description, parenthetical denomination of them as "first", "second", etc., are provided). Each base panel is provided on its abuttment sides with a connecting ledge extending from one edge of the base panel towards the center line thereof. The connecting ledge has on its front side (which is the side facing the center line) a second plug-in connecting element, and on its lateral surface (which is the surface cutting across the plane of the base panel) a (first or second) sliding connector element. The connecting ledge also has (third) plug-in connecting elements in its side faces (which are the faces facing the same direction as the plane of the base panel). The portion of the base panel abutment sides which is clear of the connecting ledge contains the complementary one of the first or second complementary sliding connector elements. The respective complementary sliding connector elements in the lateral surface and the abuttment sides, are each located at corresponding distances from their respective base panel adjacent edges, so as to permit sliding engagement with each other upon assembly.

In a preferred mode of construction, the connecting ledges extend from their respective edges of the base panel to the center line thereof. The connecting ledge front sides facing the center line have, as described above, a second plug-in connecting element. The connection ledge also has its lateral surface perpendicular to the plane of the base panel and has, as the first sliding connector element, an oblong hole extending along the lateral surface, most preferably parallel thereto. The side faces of the connecting ledge run parallel to the plane of the base panel and have (third) plug-in connecting elements located therein. The portion of the abutment sides of the base panel which is clear of the connecting ledge contains, as the second sliding connector element a peg whose distance from its adjacent edge of the base panel corresponds to the distance of the oblong hole from its adjacent edge of the base panel.

In a preferred mode of construction, the two connecting ledges of a base panel are located on respective abutment sides of the base panel, offset from each other on opposite sides of the center line of the base panel. By such construction of the base panel it is brought about that adjacent base panels can be joined to form a stable, torsion-proof compound unit. Neighboring base panels are joined together in parallel, coplanar alignment, in which arrangement the corresponding pegs are fitted into the elongated holes. The connecting ledges are then pushed together in their longitudinal direction, so that the appropriate (second) plug-in connection becomes effective. Therewith the base panels can no longer be pulled apart perpendicularly to the connecting ledge. The various plug connections hold adjacent base panels together.

The base panels and side panels are layered fiberboard or other laminated panels. The connecting ledges are solid wood or plastic ledges. Structural shapes, for instance metal sections, can also be used.

Furthermore, the invention provides that the upper and/or lower side faces of the connecting ledges parallel to the base panel plane have (third) plug-in connecting elements such as holes, and that the upper and lower edges of the side panels are furnished with (first) plug-in connecting elements such as pegs fitting into these holes. The side panels are plugged onto the connecting ledges and thereby prevent the connecting ledges from being pulled apart in their longitudinal direction. The base panels are after assembly therefore no longer directly detachable from each other.

Obviously, the invention provides also for any other equivalent interconnecting means, including reversing the role of pegs and holes as described in the above and following.

Finally, the invention provides that (fifth) plug-in connecting elements such as holes can be provided on an edge of the base panel extending between its abuttment sides and that each back panel can be equipped with (fourth) pegs fitting into these holes. The back panels are thus connected at the rear of the base panels which reinforces the assembled shelf structure in a cross direction.

Within the framework of the invention, additional connecting elements are therefore not required. It is no longer necessary to attach and anchor other clamping or locking elements of any kind. The assembly of the shelf according to the invention is therefore extremely simple.

One embodiment of the invention is explained in detail in the following description together with the attached drawings which form a part hereof and wherein.

Figures 1, 2:
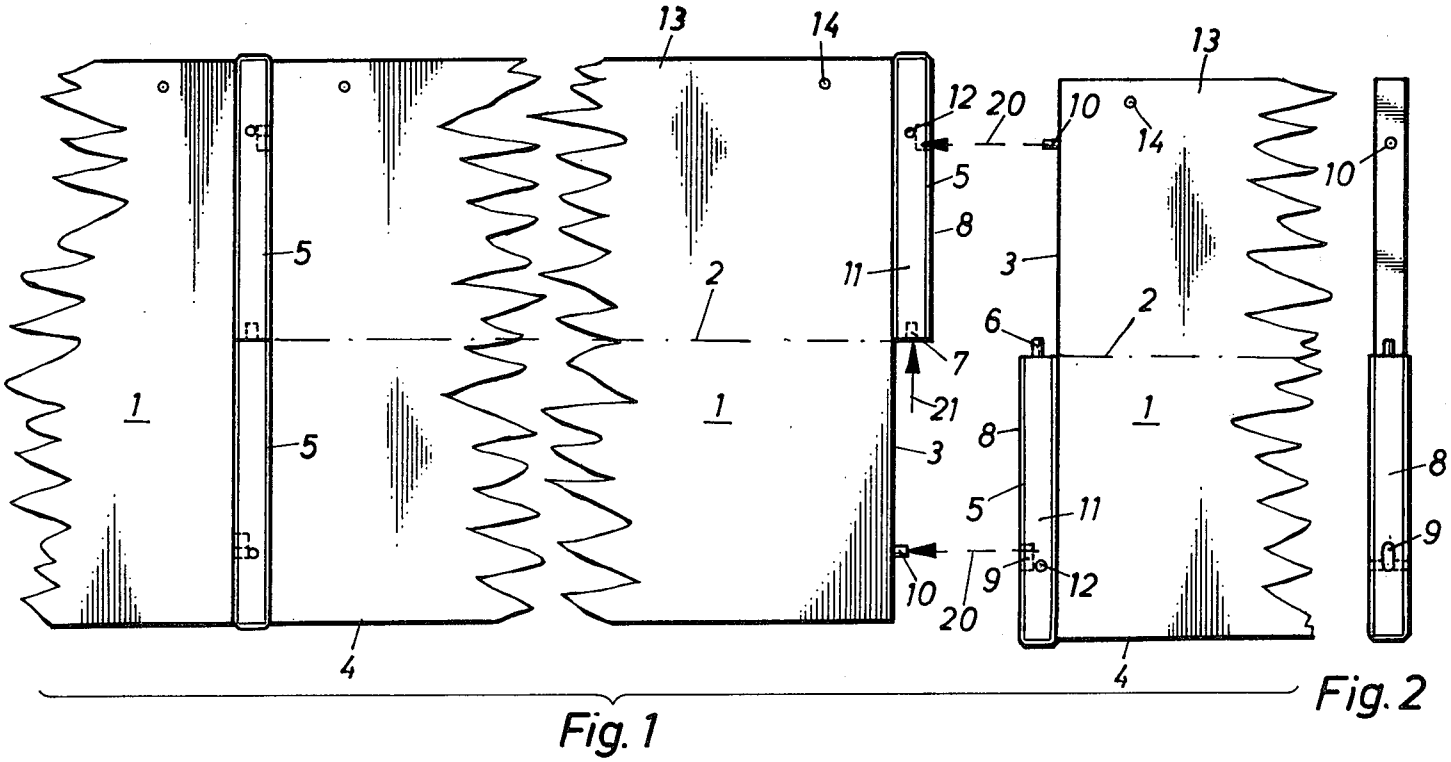
FIG. 1 is a top view with parts broken away of several base panels in various stages of assembly.
FIG. 2 is a side view of a base panel taken in the direction towards an abutment side.

FIG. 1 shows side by side several, partly broken-off base panels 1. Layered fiberboard or other laminated panels are here involved which are generally used in the furniture manufacture. Adjacent base panels always meet each other with the abutting sides perpendicularly aligned to the base panel center line 2. A connecting ledge 5 extends from an edge 4 of base panel 1 to its center line 2. The connecting ledges 5 located respectively on abutting sides of adjacent base panels are offset with reference to the center line 2 (as best seen between the right hand and center base panel segments of FIG. 1). Each connecting ledge 5 at its front face facing the center line 2 has a (second) connecting plug-in element, that is to say, a plug-in peg 6 or a hole 7. The arrangement of these connecting plug elements has been made in such a way that each base panel 1 has on one abutment side a connecting ledge with a plug-in peg 6, and on its other abutment side, a hole 7. Such connecting plug elements may be of any suitable type providing they are connectable with each other.

Each connecting ledge 5 in its lateral surface 8, located at a right angle to the plane of its base panel 1, has an oblong hole 9 whose longitudinal axis extends parallel to the connecting ledge 5. The section of the abutment side 3 adjacent to the connecting ledge 5 of each base panel has thereof a peg 10 whose distance from the adjacent edge 4 or 13 of base panel 1 is equal to the distance of oblong hole 9 from its adjacent edge 4 or 13 of base panel 1. Hole 9 and peg 10 comprise, respectively, the first and second sliding connector elements.

Holes 12 (third plug-in connecting elements) are provided in the upper and/or lower lateral surfaces 11 of the connecting ledges 5, which surfaces 11 run parallel to the plane of base panel 1.

Finally, each base panel 1 has holes 14 (fifth plug-in connecting elements) on an edge 13 connecting the abutting sides..

The described base panels 1 can be applied in any normal case and allow the joining together of any desired number of base panels 1 in the direction of center line 2, as will be explained in detail below. In addition, for the end sections of the shelf there are provided base panels 1' (FIG. 4) on which are provided on one (end) abuttment side a connecting ledge 5' which continuously extends over the entire side, from edge 4 to edge 13. This connecting ledge 5' has holes (sixth plug-in connecting elements) corresponding to holes 12 only in the upper and/or lower lateral surfaces thereof.

The assembly further provides side panels 15 (FIGS. 3 and 4) which can likewise be layered chipboard or other laminated panels. These side panels 15 have on both their upper and lower edges connecting pegs 16 (first plug-in connecting elements) which fit into the holes 12 of the connecting ledges 5 or 5' respectively. Moreover, receptacles 17 are provided in side panels 15 for mounting intermediate panels. This provision of intermediate panels is however not explained in more detail because it does not form a part of the invention.

Finally, there are provided back panels 18 (FIGS. 3 and 4) which have on their upper and lower edges pegs 19 which fit into holes 14 in base panels 1.

Figure 3:
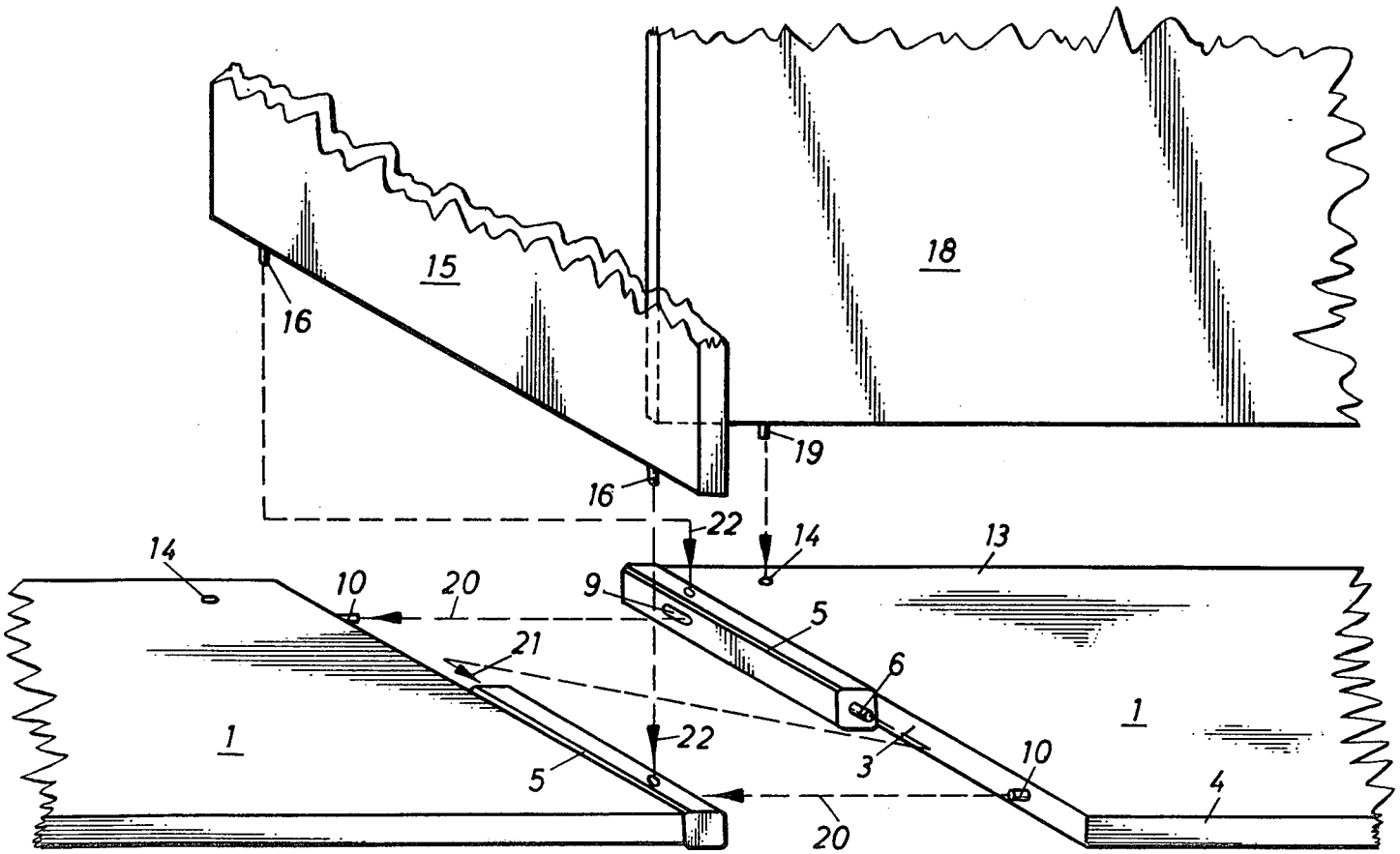
FIG. 3 is a perspective exploded view showing the cooperation of the various plug connections with the area of a connection joint.

FIG. 3 illustrates the assembly of the various panels in the area of a butt connection. First of all, the base panels 1 are aligned against each other in the manner indicated in the right hand portion of FIG. 1 and then pushed together in the direction of the arrow 20. The pegs 10 enter thereby into the oblong holes 9; more specifically, the pegs 10 enter the marginal area at one end of the oblong holes 9 and the front faces of the respective ledges of the adjacent base panels face each other. The plug-in peg 6 of our connecting ledge 5 thus faces the hole 7 of the proximate connecting ledge 5. For joining this plug-in connection, the connecting ledges 5 are pushed towards each other in the direction of the arrow 21, so that the pegs 6 enter holes 7 and base panels 1 engage each other in the manner shown in the left hand portion of the FIG. 1. In this state the panels are already secured against being pulled apart counter to the direction of the arrow 20.

Now a side panel 15 is set up, in which operation the connecting pegs 16 are inserted into the corresponding holes 12 in the direction of the arrow 22. The side panel 15 in question is thus fixed by its weight and prevents therefore a pulling apart of the connecting ledges 5 counter to the direction of the arrow 21. The side panel thus ties together adjacent base panels 1. The connection of base panel 1 is thus secured in a torsion-free manner. The base panels 1 cannot be pulled apart in any direction. Also, a mutual twisting of the bottom panels 1 around the center line 2 is not possible, because this is counteracted by three plug-in connections in all, both perpendicularly to the longitudinal direction of the connecting ledges 5, and in the longitudinal direction of the connecting ledges 5. Therefore, the base panels cannot give way even in the case of unilateral bearing pressure.

Finally the back panels 18 are set up in the manner indicated above, whereby the pegs 19 engage the holes 14. These back panels 18 stiffen the assembled shelf in cross direction, therefore in parallel to the center line.

Figure 4:
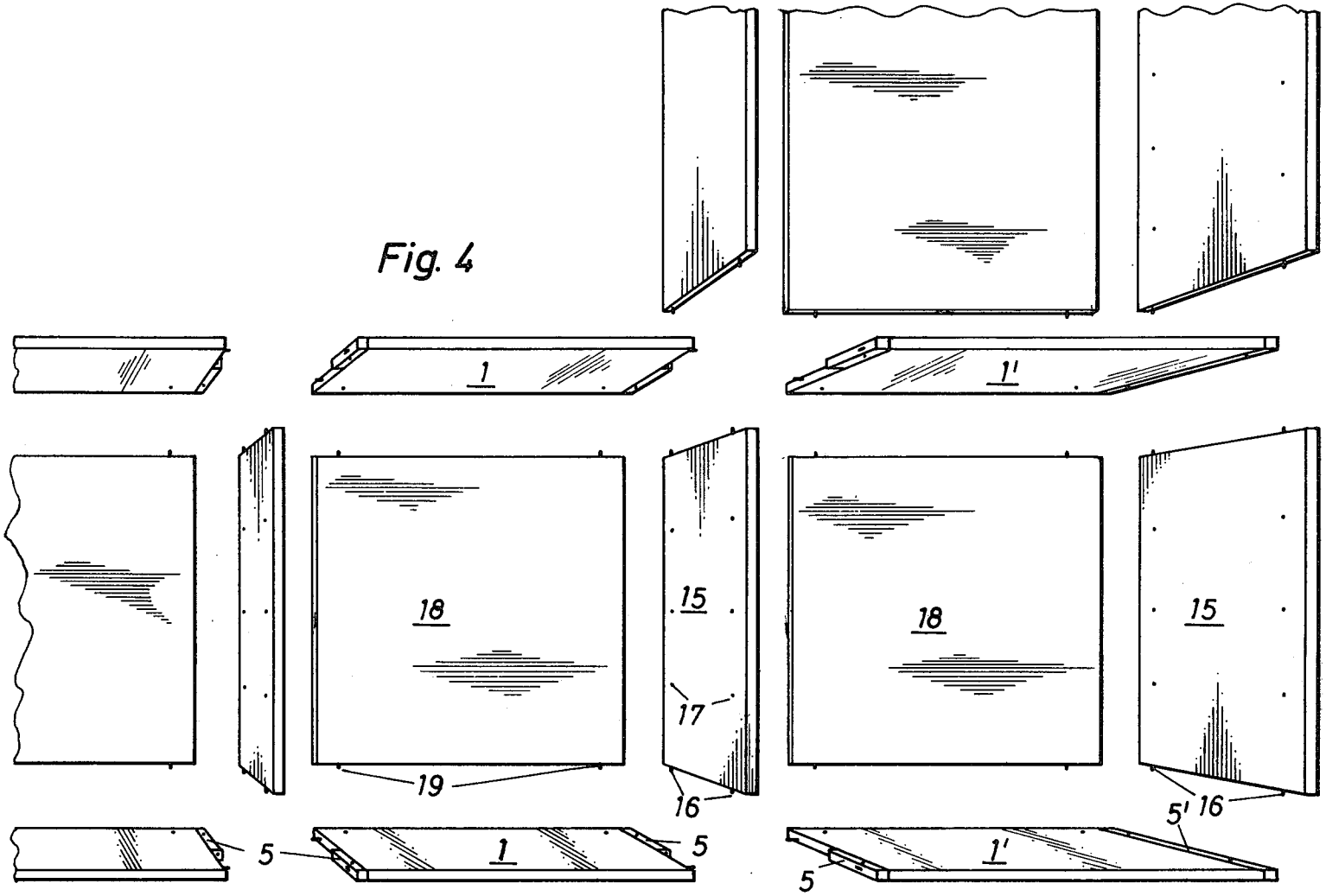
FIG. 4 is a perspective exploded view showing the arrangement of component panels of a shelf assembly.

On each of the end borders of the shelf assembly, base panels 1 are used which on their outside are provided with a continuous connecting ledge 5', as becomes apparent from FIG. 4. The entire shelf assembly presents therefore a stable, torsion-proof structure. No additional fastening or locking devices are required, so that the shelf assembly or disassembly can be easily undertaken at any time.

The shelf assembly can be produced in any customary depth. The back panel 18 can also be set up on the center line 2 of the bottom panels. The assembled shelf is in this case open toward both sides and accessible from both sides. Such a shelf can be used as a room divider.

The bottom panels, side panels and back panels can be executed in many ways, as far as color is concerned. Since the panels can be freely put together in any desired combination, the shelf can be assembled in such a way that it meets the requirements of the user and gives free rein to his imagination.

What is claimed is:

1. A shelf assembly comprises a plurality of base panels having abutment sides and side panels having upper and lower edges with first plug-in connecting elements on the upper and lower edges, the base panels having on their respective abutment sides a connecting ledge having a lateral surface on which is located a first sliding connector element, the connecting ledge extending from one edge of the base panel towards the centerline thereof and terminating short of the opposite edge of the base panel in a front face having a second plug-in connecting element thereon, thereby leaving a portion of the abutment edge clear of said connecting ledge, the base panels further having on their respective abutment sides, in the portion thereof which is clear of the connecting ledge, a complementary second sliding connector element, each of said first and second connector elements being one of an oblong hole and a peg respectively, and located a corresponding distance from its respective base panel edge so as to permit sliding engagement of said sliding connector elements with each other when adjacent base panels are placed in coplanar alignment so that the front faces of respective connecting ledges face each other and their associated second plug-in connecting elements are brought into engagement, and third plug-in connecting elements on the side faces of the connecting ledges to receive the first plug-in connecting elements on the side panels in engagement therewith, a given side panel thereby being connected to both of adjacent base panels to tie them together.

2. The shelf assembly of claim 11 further including back panels having upper and lower edges with fourth plug-in connecting elements on the upper and lower edges, and wherein the edge of the base panel extending between its abutment sides contains fifth plug-in connecting elements to receive and engage with the fourth plug-in connecting elements on the upper and lower edges of the back panel.

3. The shelf assembly of claim 2 wherein the connecting ledges terminate at the centerline of the base panels.

4. The shelf assembly of claim 2 wherein said connecting ledges extend from one edge of said base panel to the center line thereof.

5. The shelf assembly of claim 4 wherein said first sliding connector element in the lateral surface of the connecting ledge is an oblong hole and said complementary second sliding connector element in said portion of said abuttment side which is clear of said connecting ledge is a peg.

6. The shelf assembly of claim 2 wherein the connecting ledges located on opposite abutting sides of the same base panel are offset with respect to each other on opposite sides of the center line of said base panel.

7. The shelf assembly of claim 2 in which the second plug-in connecting element on the front face of the connecting ledge on one abutment side of a base panel is a peg located therein, and the second plug-in connecting element on the front face of the connecting ledge on the other abutment side of the same base panel is a complementary hole.

8. The shelf assembly of claim 2 in which selected base panels have on one abutment side thereof a continuous connecting ledge which extends from one edge of the base panel to the opposite edge of the base panel, and has sixth plug-in connecting elements in the side surfaces thereof.

9. The shelf assembly of claim 2 wherein the side faces of the connecting ledges run parallel to the plane of the base panel and the lateral surfaces of the connecting ledges run perpendicular to the plane of the base panel.

10. The assembly of claim 2 wherein said fifth plug-in connecting element comprise holes, and said fourth plug-in connecting elements comprise pegs fitting into said holes.

* * * * *